US005092468A

United States Patent [19]

Slocumb

[11] Patent Number: 5,092,468

[45] Date of Patent: Mar. 3, 1992

[54] PLASTIC NETTING FOR WRAPPING ARTICLES

[75] Inventor: Robert Slocumb, Plymouth, Minn.

[73] Assignee: Applied Extrusion Technologies, Inc., Salem, Mass.

[21] Appl. No.: 710,735

[22] Filed: Jun. 4, 1991

[51] Int. Cl.[5] ..... B65D 19/38; B65D 75/28

[52] U.S. Cl. ..... 206/597; 428/135; 428/255

[58] Field of Search ..... 53/399, 441; 206/386, 206/597; 229/87.01, 87.03; 428/134–136, 255

[56] References Cited

U.S. PATENT DOCUMENTS

| | | | |
|---|---|---|---|
| Re. 31,191 | 3/1983 | Connolly | 206/386 |
| 2,971,643 | 2/1961 | Farley | 206/83.5 |
| 3,040,968 | 6/1962 | Long et al. . | |
| 3,550,842 | 12/1970 | Scholz . | |
| 3,603,369 | 9/1971 | Scholz . | |
| 3,762,629 | 10/1973 | Bruno . | |
| 3,945,493 | 3/1976 | Cardinal | 206/386 |
| 4,136,501 | 1/1979 | Connolly | 206/597 |
| 4,204,377 | 5/1980 | Lancaster et al. | 53/399 |
| 4,206,846 | 6/1980 | Connolly | 206/597 |
| 4,208,457 | 6/1980 | Kelly et al. | 428/255 |
| 4,303,714 | 12/1981 | Mercer | 428/135 |
| 4,332,326 | 6/1982 | Kelly et al. | 206/597 |
| 4,402,409 | 9/1983 | Slocumb | 206/597 |
| 4,594,280 | 6/1986 | Coyon et al. | 428/135 |
| 4,741,442 | 5/1988 | Slocumb | 206/597 |
| 4,747,252 | 5/1988 | Kapke | 53/441 |

*Primary Examiner*—Jimmy G. Foster
*Attorney, Agent, or Firm*—Caesar, Rivise, Bernstein, Cohen & Pokotilow, Ltd.

[57] ABSTRACT

A biaxially-oriented plastic netting for use in wrapping articles includes diamond-shaped apertures formed by strands of the netting located at an acute angle to the longitudinal direction in which the web is tensioned for wrapping articles. Strips or strands of edge material are disposed along each longitudinal edge of the netting, and these strips are stretchable to an elongation for permitting the strands in the longitudinally extending central region of the netting to realign into a taught condition without substantial stretching. The strips or strands of edge material are sufficiently resistant to increasing elongation, after the strands in the longitudinally extending central region have become taut, to transmit tension forces to the strands along the longitudinally-extending edges of the netting, to thereby render the strands adjacent each longitudinal edge taut under the tension forces imparted to the netting when the netting is disposed in wrapping engagement with articles to be wrapped.

28 Claims, 1 Drawing Sheet

PLASTIC NETTING FOR WRAPPING ARTICLES

BACKGROUND OF THE INVENTION

The present invention relates generally to plastic netting for wrapping articles, and more specifically to a particular form of plastic netting for use in wrapping palletized loads and other multiple package systems, with improved results.

The wrapping of palletized loads in order to unitize the load is well known. It is taught, for example, in U.S. Pat. Nos. 3,495,375; 3,867,806 and 4,067,174, to utilize plastic films to wrap such loads.

The use of plastic netting for wrapping palletized loads also is known in the art. The use of such netting is disclosed, for example, in U.S. Pat. Nos. 3,945,493 and 4,136,501 (Re. 31,191). The former patent teaches a process in which the net is heat shrunk about the load, while the latter patent teaches a process in which the net is stretched as it is being applied under tension. U.S. Pat. No. 4,206,846 relates generally to similar subject matter for netting used in a pallet wrapping operation.

U.S. Pat. Nos. 4,208,457 and 4,332,326, disclose the use of netting in which the strands are molecularly oriented before the net is applied to the load.

U.S. Pat. No. 4,402,409 also is directed to improved netting for use in a pallet wrapping operation, in which the netting has a relatively low degree of permanent stretch and a relatively high degree of elastic stretch.

All of the plastic netting used to heretofore and referred to above in pallet wrapping operations has been of the "square mesh" configuration or "bias configuration". Although U.S. Pat. Nos. 4,332,326 and 4,402,409 make reference to "diamond mesh" configuration netting, they specifically teach cutting the formed, tubular netting in a manner to convert the netting into a "square mesh" net, before the net is used in a pallet wrapping operation.

The "square mesh" and the "bias configuration" nets of the prior art consist of longitudinal and transverse strands arranged at substantially right angles to each other. When these nets are used in pallet wrapping operations, the longitudinal strands, i.e., the strands extending in the direction of wrap (typically the machine direction of web formation) are required to sustain most of the tension, due to the fact that the tension forces are imposed along the longitudinal direction in which the machine direction strands extend. The transverse strands actually provide little or no support to the load. In fact, these transverse strands tend to buckle and become limp when the longitudinal strands are tensioned during a pallet wrapping operation. Thus, despite the fact that a load might be tightly wrapped by means of the tensioning of the longitudinal strands, the relatively loose transverse strands tend to permit the load to shift to a degree which can be unacceptable. This is particularly true when the transverse strands bridge a pair of articles stacked upon each other on a pallet or other support structure.

U.S. Patent No. 4,741,442, covers an earlier invention by me, which, at the time of filing, I believed to overcome the above-discussed deficiencies of the "square mesh" and "bias configuration" netting. Specifically, in the '442 patent I described and claimed a plastic netting for palletized loads, wherein diamond-shaped apertures were formed by strands of the netting located at an acute angle to the longitudinal direction in which the web was to be tensioned for wrapping a palletized load.

It was believed that the strands defining the diamond-shaped apertures, by virtue of the fact that they were all disposed at an acute angle to the tensioning direction, would become equally tensioned, along the entire extent of the net.

During subsequent experimentation I discovered that the netting described and claimed in the '442 patent actually had greater deficiencies than the prior art "square mesh" and "bias configuration" products. Specifically, the "diamond-shaped" netting forming the subject matter of the '442 patent had two significant problems, when used under tension as a wrap for a palletized load.

First, the netting necked-down excessively, i.e., to approximately 20%–25% of its initial transverse dimension. Specifically, a netting having an unstretched, transverse dimension of approximately 20 inches was observed to neck-down to approximately 4 or 5 inches, under the tension forces normally applied to the netting during a pallet-wrapping operation; e.g., 1–5 pounds force per inch of width.

Second, the sections of the netting adjacent the longitudinal edges were in a limp, floppy, untensioned condition under machine direction loading of the type encountered in a pallet-wrapping operation. Although the longitudinal center region of the netting did become taut, due predominately to a shifting or change in alignment of the strands, as opposed to substantial stretching of the strands in that region, the strands in the floppy end regions did not realign, and therefore were incapable of contributing to any significant degree to preventing a shifting of a palletized load. Thus, contrary to the statements in my prior '442 patent, all strands of the diamond shaped netting were not subjected to approximately equal tension when wrapped about a pallet load.

In order to compensate for the inadequacy of the floppy ends to constrain a palletized load, when employing the netting disclosed in the '442 patent, it would be necessary to provide a substantial degree of overlap between adjacent wraps of the netting, whereby floppy edges of each wrap would be covered by taut central sections of the adjacent wraps. Unfortunately, this results in the use of an excessive quantity of material, thereby resulting in undesired costs.

All of the patents referred to herein are incorporated by reference. Reference to these patents will disclose the wrapping methods used in pallet wrapping operations.

The U.S. Pat. No. 4,594,280 to Coyon et al., discloses an expanded perforated sheet having unexpanded sides 4. The structure is disclosed as being usable as an electrical resistance element, not as a flexible web of wrapping material.

The U.S. Pat. Nos. 3,040,968 to Long et al., 3,550,842 and 3,603,369, Scholz, and Bruno, 3,762,629, disclose wrappers provided with apertured central regions surrounded by unapertured margins. There is no disclosure of providing the edge regions with a different degree of elasticity than the strand regions defining the apertures, for the purpose of transmitting tension forces to the strands defining the apertures.

The U.S. Pat. No. 4,303,717, to Mercer, discloses a plastic netting having apertures 7 and integrally formed selvedge 17. Mercer states that the stretch in the edge zone 17 is not substantially greater than that of the zones between the immediately adjacent holes or depressions 7. There is no disclosure of forming the selvedge or edge zones 17 to be more elastic than the strands defining the depressions 7, for transmitting tension forces to said strands.

OBJECTS OF THE INVENTION

It is a general object of this invention to provide a plastic netting for use in wrapping articles, wherein virtually all of the strands in the netting are maintained in a taut condition to cooperate in the article wrapping function.

It is a further object of this invention to provide a plastic netting which can be used in a minimum quantity to provide a desired article wrapping function.

It is a further object of this invention to provide a plastic netting for wrapping articles, such as palletized loads, wherein the individual strands are maintained in a taut condition for providing a desired article wrapping function.

It is a further object of this invention to provide a plastic netting which can be tensioned about an article to be wrapped, without the netting necking-down excessively in the transverse dimension.

SUMMARY OF THE INVENTION

The above and other objects of this invention are provided by a biaxially-oriented plastic netting for use in wrapping articles, said netting having diamond-shaped apertures formed by strands of the netting located at an acute angle to the longitudinal direction in which the web is tensioned during a wrapping operation. The netting of this invention includes an edge material along each longitudinal edge thereof, and each of the edge materials is stretchable to an elongation for permitting the strands in the longitudinally extending central region of the netting to realign into a taut condition, without substantial stretching. The edge material, at said elongation, having sufficient resistance to an increase in elongation to transmit tension forces along the longitudinally extending edges and through the strands extending to said edges, to thereby render the strands adjacent each longitudinal edge taut under the tension forces imparted to the netting when disposed in wrapping engagement with articles to be wrapped.

In the preferred embodiment of this invention the plastic netting is employed to wrap multiple articles which are stacked adjacent to, or on top of each other, and most preferably to wrap palletized loads.

In accordance with this invention the edge material along the longitudinal edges of the netting is stretched either below or beyond its elastic limit, under the tension forces imparted to the netting when the netting is in wrapping engagement with the articles to be wrapped. When the edge material is stretched beyond its elastic limit by wrapping of articles with the netting, most preferably the tension forces imparted through the edge material to the strands attached thereto exceed the force imparted to the edge material at the elastic limit of said edge material.

BRIEF DESCRIPTION OF THE DRAWINGS

Other objects and many of the attendant advantages of this invention will be readily appreciated as the same becomes better understood by reference to the following detailed description when considered in connection the accompanying drawings, wherein.

DESCRIPTION OF THE PREFERRED EMBODIMENTS OF THE INVENTION

Figure 1:
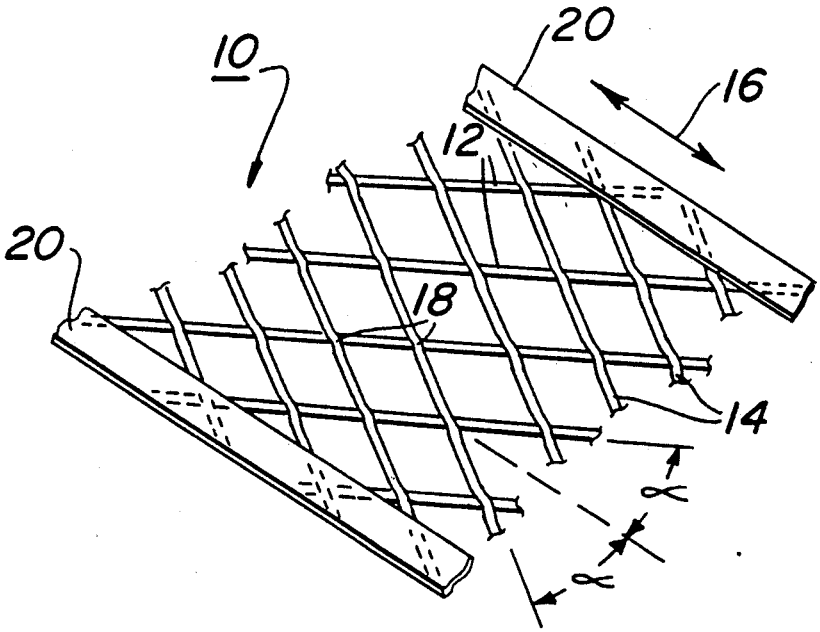
FIG. 1 is a fragmentary isometric view of a diamond mesh net in accordance with this invention.

FIG. 1 shows, in fragmentary view, a continuous plastic netting 10 of biplanar diamond mesh configuration in which one set of strands 12 overlies a second set of strands 14 and wherein both sets of strands are disposed at an acute angle, alpha ($\alpha$), to the machine direction of web formation, as is illustrated by the arrow 16.

In the preferred embodiment of this invention the strands are composed of a thermoplastic material which is extruded in accordance with known procedures to form the net 10 with the sets of strands 12 and 14 being connected at joints 18. Although the sets of strands 12 and 14 do extend generally in the longitudinal direction of net formation, as is illustrated by arrow 16, they are all disposed at an acute angle alpha ($\alpha$) of less than 90 degrees to said longitudinal direction. Specifically, each of the sets of parallel strands 12 and 14 extend generally in the longitudinal direction, i.e., the direction of wrap, but at an angle alpha ($\alpha$) of less than 90 degrees upwardly or downwardly with respect to said longitudinal direction to provide two sets of strands which share tension applied to the netting 10 in the longitudinal direction, at least in the central longitudinal region thereof. Typically this longitudinal direction is also the machine direction of web formation.

In accordance with this invention the netting is biaxially-oriented, and most preferably is oriented within the range of 4:1–20:1, and most preferably in the range of 8:1–10:1. Typically, orientation will be accomplished on staged drafter rolls in a normal manner, as is well known by those skilled in the art.

It also should be understood that although the preferred netting is of the biplanar arrangement shown in FIG. 1, it may be uniplanar of the type produced in U.S. Pat. No. 2,919,467. However, the biplanar configuration, which also is described in the '467 patent, is the most preferred construction in accordance with this invention. The subject matter of the '467 patent is herein incorporated by reference.

Any of a wide variety of thermoplastic materials commonly used in the manufacturing of extruded netting may be utilized for the netting of this invention, provided that the material is capable of being biaxially-oriented, to thereby limit the ability of the individual strands of the netting to stretch. Most preferably the material is biaxially-oriented so that the individual strands of the netting, when the netting is in use under tension, will not thereafter stretch more than 15%; preferably not more than 10% and most preferably less than 5% of the length of the tensioned strands.

Exemplary thermoplastic materials which may be usable in this invention are polypropylene, blends of polypropylene and linear low density polyethylene, linear low density polyethylene, high density polyethylene, medium density polyethylene, polybutylene and blends and copolymers thereof.

Referring specifically to FIG. 1, edge material 20, preferably in the form of strips or strands, are adhered to the plastic netting, along each of the longitudinal edges of said netting.

Unlike the biaxially-oriented plastic employed to form the netting strands 12 and 14, the edge material 20 must be stretchable (e.g., elastic) to an elongation sufficient to permit the biaxially-oriented strands 12 and 14 in the main body of the netting to shift or change in alignment, under the stresses imposed in the longitudinal direction of the netting during an article wrapping operation, to thereby cause the main body of the netting to become taut.

Figure 2:
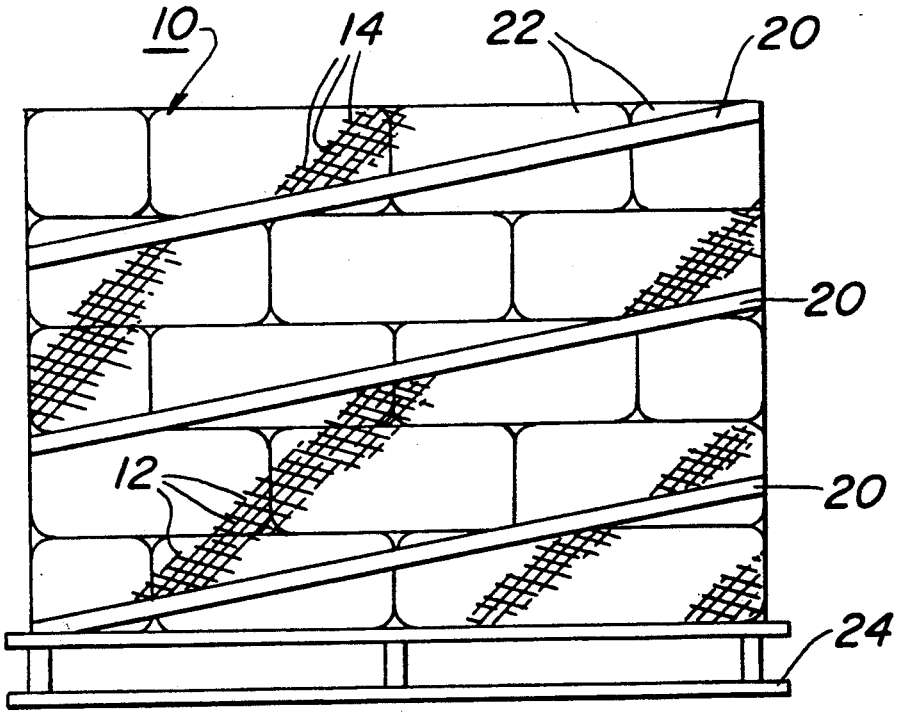
FIG. 2 is an end elevation view showing a typical palletized load according to the present invention; being wrapped with the netting of this invention.

When the netting 10 is tensioned about the articles to be wrapped (e.g. articles 22 supported on a pallet 24—FIG. 2) the edge material 20 thereof is stretched either below or beyond its elastic limit. If the edge material 20 is of the type which is stretched beyond its elastic limit when tensioned about the articles to be wrapped, most preferably it provides increasing resistance to increasing strain, beyond the elastic limit, to thereby transmit a force along the edge material and the netting strands attached thereto, which is greater than the force imparted to the edge material at the elastic limit thereof.

During wrapping of the netting about the articles to be wrapped, which usually takes place under an applied force in the range of 1 and 5 pounds of force per inch of width, the force transmitted through the stretched edge material 20 must be sufficient to prevent the longitudinal edge regions of the netting from becoming floppy, and also to prevent an undesired degree of necking-down of the netting, in a transverse direction.

As stated above, edge materials within the scope of this invention are ones which both exceed and which do not exceed their elastic limit when stretched to a required elongation, for permitting the sets of strands 12 and 14, at least in the central longitudinal region thereof, to realign into a taut condition. The important factor is that the edge material should be sufficiently resistant to increasing strain at the required elongation, to transmit the necessary forces to the sets of strands 12 and 14 of the netting 10 along the longitudinal edges of the netting, to maintain the netting taut in the regions along the longitudinal edges thereof.

A number of different materials are believed to be usable in this invention to form the edge materials 20, including linear low density polyethylene, flexible polyvinyl chloride and thermoplastic elastomers or rubbers, such as Santoprene or Kraton. Polybutylene and polypropylene also are possible candidates for use in the edge material. However, the plastics used to form the edge materials will not be biaxially-oriented to impair the stretchable characteristics thereof.

It is understood that the plastic netting 10 initially can be extruded in the form of a tube, and that the edge material can be simultaneously bonded to the tube, prior to forming the netting 10 by severing the tube midway between the longitudinal edges of the edge material. In this manner the tube is opened into a flat netting 10, with the strips of edge material 20 along each longitudinal edge thereof.

It is also within the scope of this invention to coextrude the edge material along with the tubular netting; thereafter bond the coextruded edge material to the tubular netting and thereafter sever the tube along the center line of the coextruded edge material.

The specific method used to form the netting 10 is not considered to be a limitation on the present invention.

Without further elaboration the foregoing will so fully illustrate my invention that others may, by applying current or future knowledge, adopt the same for use under various conditions of service.

I claim:

1. A pallet load wrapped with at least one continuous length of plastic netting, the length of plastic netting extending in a longitudinal direction and having one set of spaced substantially parallel strands extending at an angle of less than 90 degrees upwardly with respect to the longitudinal direction and a second set of spaced substantially parallel strands overlying the first set and extending at an angle of less than 90 degrees downwardly with respect to the longitudinal direction, said strands being joined at the intersections thereof and providing a diamond-like configuration to the netting, the netting including longitudinally extending edges substantially parallel to the longitudinal direction of the netting, said netting being biaxially oriented to preclude substantial stretching of the strands thereof under the tension forces applied in said longitudinal direction to wrap the pallet load with the netting, said one set of strands and said other set of strands being movable relative to each other under the tension forces applied in said longitudinal direction to permit elongation of the netting without substantial stretching of the strands, characterized in that an edge material extends along each longitudinal edge and is joined to both sets of strands, said edge materials being stretchable to a greater extent than the strands in both sets of strands under the tension forces applied to the netting in the longitudinal direction to wrap the pallet load, said tension forces being transmitted along the stretched edge material and the strands of the netting joined thereto so that substantially all of the netting strands, from one longitudinal edge portion to the other longitudinal edge portion in a direction substantially transverse to said longitudinal direction are maintained in a taut condition and under sufficient tension for immobilizing the wrapped pallet load.

2. The pallet load of claim 1, wherein the edge material is stretched beyond its elastic limit under the tension forces applied to the netting to wrap the pallet load.

3. The pallet load of claim 2, wherein the stretched edge material transmits along its length a force which is greater than the force imparted to said material at the elastic limit of said material.

4. The pallet load of claim 1, wherein the edge material is of a different material than the material of the strands of the netting.

5. The pallet load of claim 4, wherein the edge material and the material of the strands of the netting are both thermoplastic materials.

6. The pallet load of claim 5, wherein the edge material is stretched beyond its elastic limit under the tension forces applied to the netting to wrap the pallet load.

7. The pallet load of claim 6, wherein the stretched edge material transmits along its length a force which is greater than the force imparted to said material at the elastic limit of said material.

8. The pallet load of claim 4, wherein the edge material is stretched beyond its elastic limit under the tension forces applied to the netting to wrap the pallet load.

9. The pallet load of claim 8, wherein the stretched edge material transmits along its length a force which is greater than the force imparted to said material at the elastic limit of said material.

10. The pallet load of claim 1, wherein the edge material and strands of the netting are adhered together by a adhesive.

11. The pallet load of claim 1, wherein the edge material and strands of the netting are simultaneously extruded and thereafter adhered together.

12. The plastic netting of claim 1, wherein the edge material and strands of the netting are adhered together by a adhesive.

13. The plastic netting of claim 1, wherein the edge material and strands of the netting are simultaneously extruded and thereafter adhered together.

14. The pallet load of claim 1, wherein the edge material is stretched below its elastic limit under the tension forces applied to the netting to wrap the pallet load.

15. A plastic netting for use in wrapping articles, said netting having a longitudinally extending dimension extending in a longitudinal direction and a transversely extending dimension substantially perpendicular to said longitudinal direction and terminating at opposed longitudinally extending edges, said netting including one set of spaced substantially parallel strands extending at an angle of less than 90 degrees upwardly with respect to the longitudinal direction and a second set of spaced substantially parallel strands overlying the first set and extending at an angle of less than 90 degrees downwardly with respect to the longitudinal direction of the netting length, said strands being joined at the intersections thereof and providing a diamond-like configuration to the netting, said netting being biaxially oriented to preclude substantial stretching of the strands thereof under tension forces applied in said longitudinal direction to wrap articles with the netting, said one set of strands and said other set of strands being movable relative to each other under the tension forces applied in said longitudinal direction to permit elongation of the netting without substantial stretching of the strands, characterized in that an edge material extends along each longitudinal edge and is joined to both sets of strands, said edge material being stretchable to a greater extent than the strands in both sets of strands under the tension forces applied to the netting to wrap the articles, said tension forces being transmitted along the stretched edge material and the strands of the netting joined thereto so that substantially all of the netting strands, from one longitudinal edge to the other longitudinal edge in a direction substantially transverse to said longitudinal direction are maintained in a taut condition and under sufficient tension for immobilizing the wrapped articles.

16. The plastic netting of claim 15, wherein the edge material is stretched beyond its elastic limit under the tension forces applied to the netting to wrap the articles.

17. The plastic netting of claim 16, wherein the stretched edge material transmits along its length a force which is greater than the force imparted to said material at the elastic limit of said material.

18. The plastic netting of claim 15, wherein the edge material is of a different material than the material of the strands of the netting.

19. The plastic netting of claim 18, wherein the edge material and the material of the strands of the netting are both thermoplastic materials.

20. The plastic netting of claim 17, wherein the edge material is stretched beyond its elastic limit under the tension forces applied to the netting to wrap the articles.

21. The plastic netting of claim 20, wherein the stretched edge material transmits along its length a force which is greater than the force imparted to said material at the elastic limit of said material.

22. The plastic netting of claim 18, wherein the edge material is stretched beyond its elastic limit under the tension forces applied to the netting to wrap the articles.

23. The plastic netting of claim 22, wherein the stretched edge material transmits along its length a force which is greater than the force imparted to said material at the elastic limit of said material.

24. The plastic netting of claim 15, wherein the edge material is stretched below its elastic limit under the tension forces applied to the netting to wrap the articles.

25. A biaxially oriented plastic netting for use in wrapping articles, said netting having diamond-shaped apertures formed by strands of the netting located at an acute angle to the longitudinal direction in which the web is tensioned for wrapping articles, characterized in that said netting includes an edge material along each longitudinal edge thereof, said edge material being stretchable to an elongation for permitting the strands in the longitudinally extending central region to realign into a taut condition without substantial stretching, said edge material, at said elongation, having sufficient resistance to increasing elongation to transmit tension forces to the strands along the longitudinally extending edges to render the strands adjacent each longitudinal edge taut under the tension forces imparted to the netting when it disposed in wrapping engagement with said articles to be wrapped.

26. The plastic netting of claim 25, characterized in that the edge material is stretched beyond its elastic limit under the tension forces imparted to the netting when said netting is in wrapping engagement with the articles to be wrapped.

27. The plastic netting of claim 26, characterized in that the tension force imparted to the strands through the edge material exceeds the force imparted to the edge material at the elastic limit of said edge material.

28. The plastic netting of claim 25, characterized in that the edge material is stretched below its elastic limit under the tension forces imparted to the netting when said netting is in wrapping engagement with the articles to be wrapped.

* * * * *